US009366467B2

(12) United States Patent
Kiedaisch et al.

(10) Patent No.: US 9,366,467 B2
(45) Date of Patent: Jun. 14, 2016

(54) ICELESS CHILL CHAMBER COOLER

(71) Applicants: Gary Kiedaisch, Newington, NH (US); John Maldonado, Katy, TX (US)

(72) Inventors: Gary Kiedaisch, Newington, NH (US); John Maldonado, Katy, TX (US)

(73) Assignee: IGLOO PRODUCTS CORP., Katy, TX (US)

( * ) Notice: Subject to any disclaimer, the term of this patent is extended or adjusted under 35 U.S.C. 154(b) by 101 days.

(21) Appl. No.: 13/922,467

(22) Filed: Jun. 20, 2013

(65) Prior Publication Data

US 2013/0340467 A1 Dec. 26, 2013

Related U.S. Application Data

(60) Provisional application No. 61/662,043, filed on Jun. 20, 2012.

(51) Int. Cl.
*F25D 3/00* (2006.01)
*F25D 3/08* (2006.01)

(52) U.S. Cl.
CPC .. *F25D 3/00* (2013.01); *F25D 3/08* (2013.01); *F25D 2303/0843* (2013.01); *F25D 2303/08221* (2013.01); *F25D 2331/804* (2013.01); *Y10T 29/49* (2015.01); *Y10T 29/49359* (2015.01)

(58) Field of Classification Search
CPC ... F25D 3/00; F25D 3/08; F25D 2303/08221; F25D 2331/804; F25D 2303/0843; Y10T 29/49359; Y10T 29/49
USPC ..... 62/457.2, 529, 530; 29/592, 890.035; 220/500, 592.2
See application file for complete search history.

(56) References Cited

U.S. PATENT DOCUMENTS

| | | | | |
|---|---|---|---|---|
| 4,336,883 | A * | 6/1982 | Krug et al. | 206/545 |
| 5,533,361 | A * | 7/1996 | Halpern | 62/457.2 |
| 5,570,588 | A * | 11/1996 | Lowe | 62/457.7 |
| 6,209,343 | B1 * | 4/2001 | Owen | 62/457.2 |
| 6,244,458 | B1 * | 6/2001 | Frysinger et al. | 220/592.09 |
| 6,412,545 | B1 * | 7/2002 | Buff et al. | 165/10 |
| 6,968,711 | B2 * | 11/2005 | Smith et al. | 62/371 |
| 7,240,513 | B1 * | 7/2007 | Conforti | 62/457.2 |
| 8,613,202 | B2 * | 12/2013 | Williams | 62/60 |
| 2001/0048985 | A1 * | 12/2001 | Legare | 428/34.6 |
| 2003/0010041 | A1 * | 1/2003 | Wessling et al. | 62/60 |
| 2003/0082357 | A1 * | 5/2003 | Gokay et al. | 428/212 |
| 2005/0031809 | A1 * | 2/2005 | Romero | 428/34.1 |
| 2005/0106341 | A1 * | 5/2005 | Legare | 428/34.4 |
| 2008/0164265 | A1 * | 7/2008 | Conforti | 220/592.2 |
| 2009/0178437 | A1 * | 7/2009 | Mak | 62/530 |
| 2009/0184143 | A1 * | 7/2009 | Witt et al. | 224/153 |
| 2009/0301511 | A1 * | 12/2009 | Vinci | 132/316 |

* cited by examiner

*Primary Examiner* — Mohammad M Ali
(74) *Attorney, Agent, or Firm* — King & Spalding LLP

(57) ABSTRACT

An iceless chill chamber cooler includes a chill chamber block and an iceless chill chamber. The chill chamber block can include at least one attachment feature. The iceless chill chamber can include a wall having at least one receiving feature. The receiving feature can complement and receive the attachment feature of the chill chamber block. The chill chamber block can be configured to transfer cold to an item positioned inside the iceless chill chamber.

15 Claims, 6 Drawing Sheets

ICELESS CHILL CHAMBER COOLER

CROSS-REFERENCE TO RELATED APPLICATIONS

The present application claims priority to U.S. Provisional Patent Application No. 61/662,043 titled "Iceless Chill Chamber Cooler" and filed Jun. 20, 2012, the entire contents of which are incorporated herein by reference.

TECHNICAL FIELD

Embodiments described herein relate generally to portable coolers, and more particularly to systems, methods, and devices for providing reusable, iceless cooling for a portable cooler.

BACKGROUND

Portable coolers are commonly used in a number of different applications. In a number of cases, the methods to cool items inside a portable cooler are messy, expensive, and/or inefficient. For example, ice can be used in portable coolers to keep food and drinks cold. Ice can be obtained from the refrigerator, freezer, or purchased at a neighborhood convenience store, gas station, or grocery store. After use, the melted ice is purged from the cooler and the remaining ice is discarded. Some of the problems with using ice include the fact that melted ice can spoil food items such as sandwiches and snacks as it melts; as drinks are consumed, a user must dig through cold ice to "fish" out his or her beverage, causing cold discomfort on the hands and arms; ice cubes or chunks of ice melt at a faster rate than one large mass of ice; and ice is not common or readily available outside the U.S.A.

Reusable freezer blocks, soft ice packs, gel packs, and ice sheets are common alternatives to ice. Some are pre-filled with freezable gel while others are filled with tap water. Typically these are tossed in and around the inside of the cooler or in the case of a soft-sided cooler, an ice pocket is sewn to the underside of the cooler lid. Some of the problems associated with the use of freezer blocks include the fact that current freezer blocks, gel packs or other ice alternatives are placed inside the cooler in-between food and beverages taking up valuable space inside the cooler; the ice blocks and ice alternatives rattle around and fall over inside the cooler without the ability of being strategically located for optimum performance. Furthermore, some coolers have been developed with snaps or toggles to locate ice blocks to the underside of the cooler lid. In this instance, the cooling block is above the food and drinks and natural physics of heat rising diminishes the ability of the ice block to cool the contents of the cooler. Furthermore, heat and thermal conduction from the cooler lid causes the ice block to melt faster, perspire and drip condensation onto food and drinks resulting in the same issue as was caused with melted ice.

There are also Thermoelectric (TE) coolers that are powered by an AC or DC source and combine mechanical parts such as fans, heat sinks and solid state technology referred to as a Peltier cooling system. The Thermoelectric Cooler is also known as an "iceless cooler". Some of the problems typically associated with TE coolers include the fact that coolers are mostly used outdoors where electricity is not available; coolers are typically designed to be portable and carried from the home or auto to another destination, and the mechanical components of the TE cooler add significant weight making it less portable; TE coolers chill based on the performance of the Peltier system and the surrounding ambient temperature and current embodiments used on a hot sunny day of 95 degrees Fahrenheit can only reduce the temperature inside of the cooler to about 55-63 degrees Fahrenheit, well above a thirst satisfying temperature range; and TE coolers are typically four times the cost of passive or traditional coolers of equivalent size.

BRIEF DESCRIPTION OF THE DRAWINGS

Reference will now be made to the accompanying drawings, which are not necessarily drawn to scale, and wherein.

DETAILED DESCRIPTION OF EXAMPLE EMBODIMENTS

Figure 1:
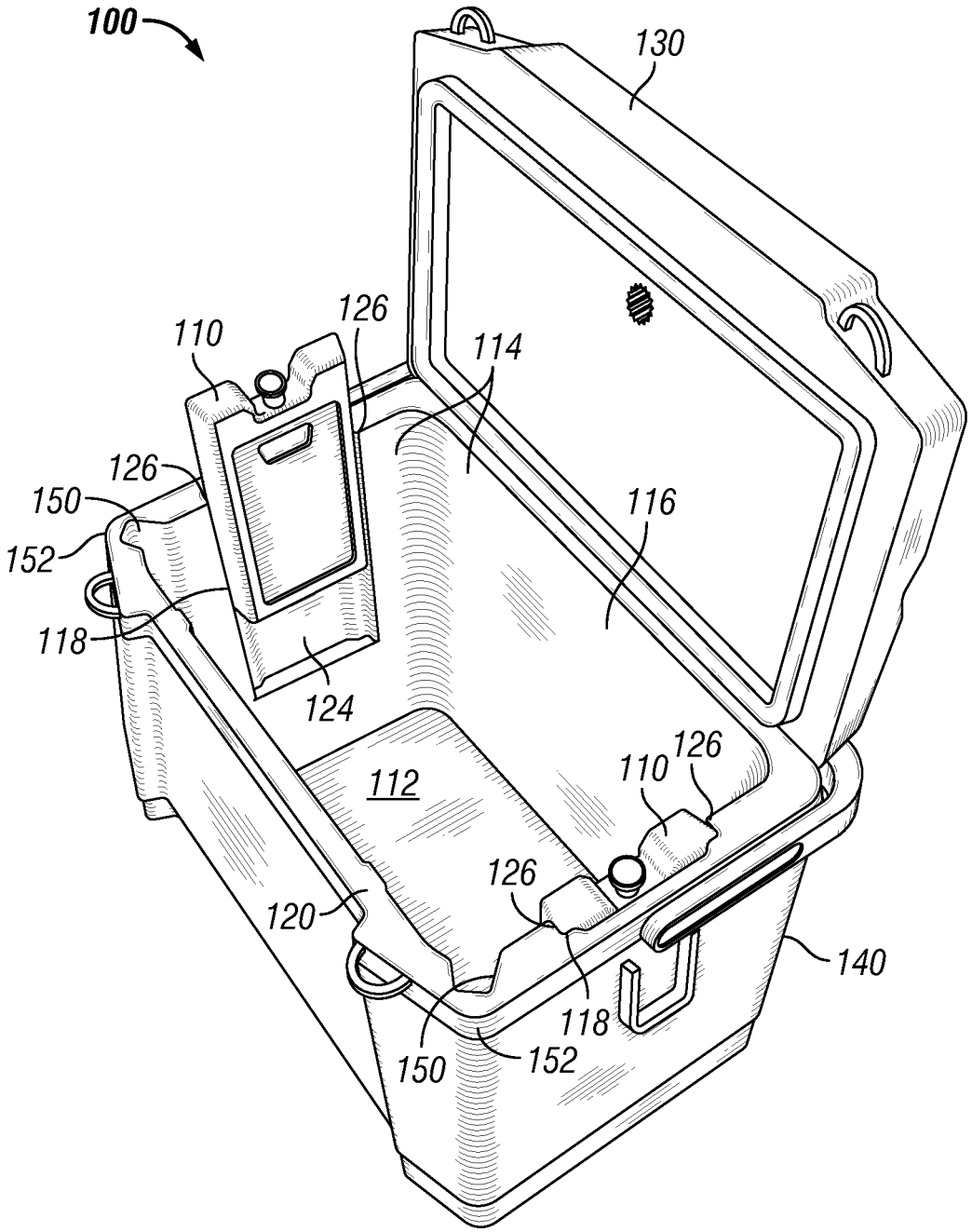
FIG. 1 shows a perspective view of an iceless chill chamber cooler of a hard-sided cooler, in accordance with one or more exemplary embodiments.

The exemplary embodiments discussed herein are directed to various aspects (e.g., methods, systems, devices) of an iceless chill chamber cooler. Exemplary embodiments of an iceless chill chamber cooler may be integrated with a cooler, inserted into a cooler designed to have a removable hard liner, and/or retrofitted into an existing hard-side and/or soft-side cooler. In certain exemplary embodiments, the iceless chill chamber cooler may be used in one or more of a number of different cooler sizes with various lengths, widths, heights, and/or capacities.

The exemplary embodiments described herein may provide one or more of the following advantages including, but not limited to, keeping items inside a cooler at a lower temperature for a longer period of time, keeping items inside the cooler from becoming overly wet, reducing costs by having reusable chill chamber blocks, easier storage by having stackable chill chamber blocks, increasing space and organization inside the cooler by using slots into which the chill chamber blocks are positioned, and ease of cleaning and maintenance.

Exemplary embodiments of iceless chill chamber coolers will be described more fully hereinafter with reference to the accompanying drawings, in which example embodiments of iceless chill chamber coolers are shown. Iceless chill chamber coolers may, however, be embodied in many different forms and should not be construed as limited to the exemplary embodiments set forth herein. Rather, these exemplary embodiments are provided so that the present disclosure will be thorough and complete, and will fully convey the scope of iceless chill chamber coolers to those of ordinary skill in the art. Like, but not necessarily the same, elements in the various figures are denoted by like reference numerals for consistency.

FIG. 1 illustrates a perspective view of an iceless chill chamber cooler 100 in accordance with one or more exemplary embodiments. In certain exemplary embodiments, the iceless chill chamber cooler 100 includes an iceless chill chamber 120, a cooler body 140 and a lid 130. In certain exemplary embodiments, the lid 130 is removable from the cooler body 140. In other exemplary embodiments, the lid 130 is hingedly coupled to the cooler body 140 such that the lid 130 is moveable to provide access to the iceless chill chamber 120 and an interior cavity 116, described below. The cooler body 140 includes a bottom surface 112 and multiple side wall surfaces 114 extending substantially orthogonally away from the perimeter of the bottom surface 112. The bottom surface 112 and the side wall surfaces 114 define the interior cavity 116 of the cooler body 140. Inside the cooler body 140 is the iceless chill chamber 120. In certain exemplary embodiments, the iceless chill chamber 120 is integrated with the cooler body 140 and forms one or more of the inner side wall surfaces 114 of the cooler body 140. In certain other exemplary embodiments, the iceless chill chamber 120 is separable from the cooler body 140 or can retrofit an existing conventional cooler body (not shown).

In one or more exemplary embodiments, one or more inner side wall surfaces 114 of the iceless chill chamber 120 includes one or more receiving features 118, cut outs or slots. For example, in FIG. 1, at least one of the inner side wall surfaces 114 has a receiving feature 118 in the form of a slot (e.g., protrusions and recesses). The receiving features 118 are each configured to receive and retain a chill block 110, which is described in further detail below. Specifically, in the example provided in FIG. 1, two opposing inner side wall surfaces 114 of the iceless chill chamber 120 each have a receiving feature 118. Each of the receiving features 118 further includes a recessed surface 124 and/or one or more protruding elements 126. The recessed surfaces 124 and the protruding elements 126 are configured to receive and retain one or more chill chambers 110 therebetween. In this example, each chill block 110 is slidably positioned into the slots 118 defined by the recessed surfaces 124 and the protruding elements 126. Specifically, in certain exemplary embodiments, the chill block 110 is insertable into and removable from the receiving feature 118 by vertically aligning a bottom end of the chill block 110 with the top end of the receiving feature 118, and sliding the chill block 110 downwardly into the respective receiving feature 118 when the chill chamber 120 is in the up-right position. In such an exemplary embodiment, when the chill block 110 is disposed within the receiving feature 118, it is generally horizontally locked within the receiving feature 118. The example of FIG. 1 illustrates one chill block 110 being partially slid, or in the process of being disposed, into the receiving feature 118 and another chill block 110 being entirely positioned, or disposed, within another respective receiving feature 118.

In certain other exemplary embodiments, the chill block 110 is insertable into and/or removable from the receiving feature 118 through substantial horizontal movement of the chill block 110. For example, the chill block 110 may by snapped into and/or out of the receiving feature 118 by applying a force, in which the force is generally greater than that of gravity.

In certain exemplary embodiments, while not shown, multiple chill blocks 110 (having the same or different dimensions as shown) is insertable into a single receiving feature 118, for example, in a vertically aligned orientation. In other exemplary embodiments, the chill blocks 110 are alternatively, or are additionally, coupled to the iceless chill chamber 120 using one or more other types of receiving features, including but not limited to a fastening device, such as a screw, a threaded peg and nut, a snap, or a strap, which may include Velcro or other similar coupling means. Further, in certain exemplary embodiments, the bottom 112 of the iceless chill chamber 120 includes a receiving feature 118 or other coupling mechanism. Thus, in such exemplary embodiments, the chill block 110 is couplable to the bottom 112 of the iceless chill chamber 120. In certain alternative embodiments, the lid 130 of the iceless chill chamber 120 also includes an optional coupling mechanism which, alternatively or in addition, is configured to receive one or more chill blocks 110.

In certain exemplary embodiments, the receiving features 118 of the iceless chill chamber 120 are configured to complement and receive a corresponding attachment feature of the chill chamber block 110. In certain exemplary embodiments, the top of the chill block 110, when positioned in the receiving feature 118 of the iceless chill chamber 120, is substantially flush with the tops of the walls 114 of the iceless chill chamber 120. Alternatively, the top of the chill block 110, when positioned in the receiving features 118 of the iceless chill chamber 120, is lower than the walls of the iceless chill chamber 120. In certain exemplary embodiments, when the chill blocks 110 are positioned in the receiving features 118, or slots, of (and/or otherwise secured within) the iceless chill chamber 120, the chill blocks 110 are secure and will not fall out or otherwise substantially move during transportation or use, such as when a user adds or removes items from the iceless chill chamber 120. The receiving feature 118 is described in further detail below with respect to FIGS. 2 and 3, in which the receiving feature 118 is more clearly illustrated. Likewise, the chill block 110 is further described with respect to FIGS. 5*a*, 5*b*, and 5*c* of the present disclosure.

In certain exemplary embodiments, the iceless chill chamber 120 or the cooler body 140 further includes one or more pour spouts 150. In the exemplary embodiment of FIG. 1, each pour spout 150 is formed as a recessed portion at one or more corners 152 of the iceless chill chamber 120 or cooler body 140. The pour spout 150 forms a recessed channel which is used in certain exemplary embodiments to easily pour out liquid from within the iceless chill chamber 120.

The exemplary iceless chill chamber 120 is manufactured from one or more of a number of materials, including but not limited to plastic, aluminum, stainless steel, and copper. The inner and outer walls of the cooler 100 is manufactured from the same or different materials and is of a single unitary piece or of multiple pieces with insulation positioned between the inner and outer side, bottom or top walls of the cooler 100. The materials used are based on one or more of a number of factors, including but not limited to cost, aesthetics, convection effects, thermal insulation benefits, and conduction effects.

Figure 2:
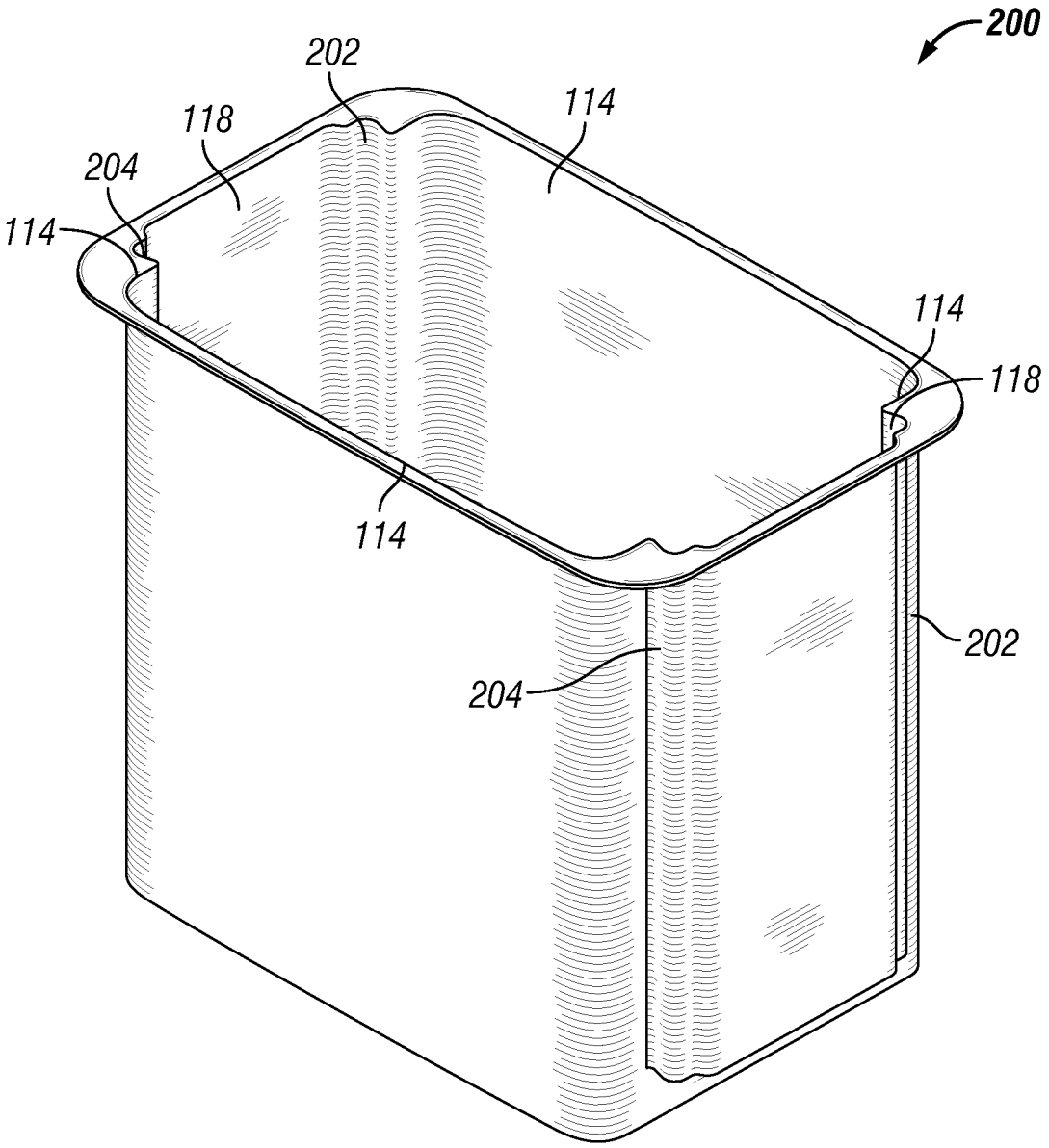
FIG. 2 shows a perspective view of an iceless chill chamber cooler that is insertable into a soft-sided cooler, in accordance with another exemplary embodiment.
Figure 3:
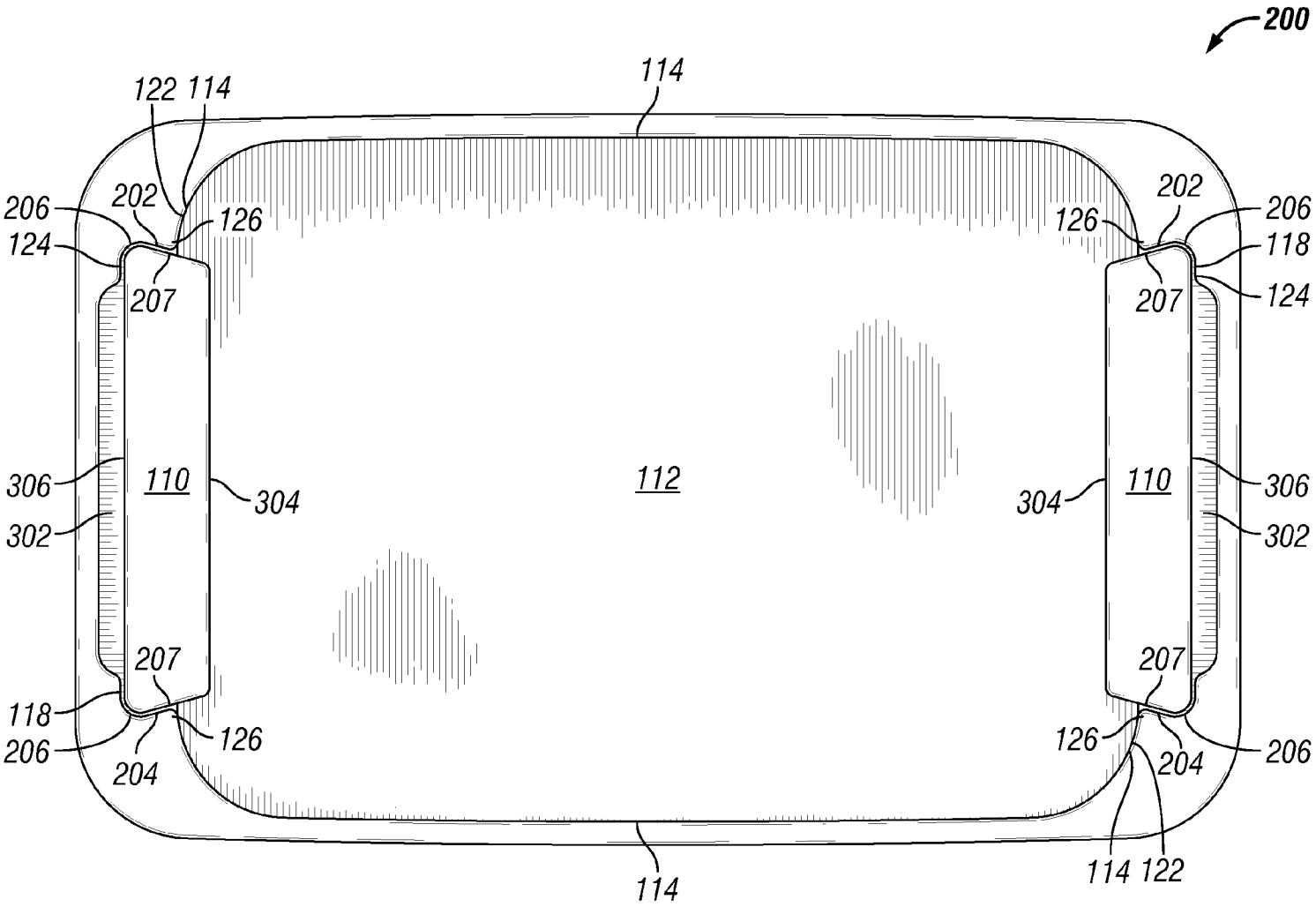
FIG. 3 shows a top view of the iceless chill chamber cooler of FIG. 2 with chill blocks, in accordance with one or more exemplary embodiments.

FIG. 2 shows a perspective view of an iceless chill chamber 200 that is insertable into a soft-sided cooler 402 (FIG. 4), in accordance with another exemplary embodiment of the present disclosure. FIG. 3 shows a top view of the iceless chill chamber 200 (FIG. 2), in accordance with one or more exemplary embodiments of the present disclosure. Referring to FIGS. 2 and 3, the iceless chill chamber 200 includes one or more walls 114, a base 112, and one or more receiving features 118 formed in at least one wall 114. In the example of FIGS. 2 and 3, the iceless chill chamber 200 includes two receiving features 118 formed in opposing walls 114. The receiving feature 118 is similar to that shown in FIG. 1, and the following description of the receiving feature 118 provided with reference to FIGS. 2 and 3 also is applicable to other exemplary embodiments of the present disclosure, including FIG. 1. However, other exemplary embodiments of the present disclosure, including other exemplary embodiments of FIG. 1, include receiving features 118 which differ from those described herein with reference to FIGS. 2 and 3, while remaining in the scope of the present disclosure. For example, the geometry of the receiving features 118 that prevent the chill block 110 from being horizontally displaced from the receiving features 118 is different so long that the chill block 110 is still prevented from being horizontally displaced from the receiving features 118.

Referring to FIGS. 2 and 3, the receiving feature 118 includes a first vertical siding 202 and a second vertical siding 204 opposite the first vertical siding 202. In certain example embodiments, the vertical sidings 202, 204 couple, or provide transition from, the recessed surfaces 124 of the receiving features 118 to the sidewall 114. Thus, when the chill blocks 110 are retained within the receiving features 118, the chill blocks 110 are disposed between the first vertical siding 202 and the second vertical siding 204. The vertical sidings 202, 204 further provide a guided path for inserting the chill block 110. Each of the vertical sidings 202, 204 extend horizontally from a back end 206, which is coupled to the recessed surface 124, to a distal end 207 which is coupled to the sidewall 114. At least one of the vertical sidings 202, 204 includes an inward facing protrusion 126 formed between the back end 206 and the distal end 207. In certain example embodiments, the protrusions 126 are formed at the distal end 207, such as in the example of FIGS. 2 and 3. In certain exemplary embodiments, the distance between the protrusion 126 of the first vertical siding 202 and the protrusion 126 of the second vertical siding 204 is smaller than the maximum distance between the first vertical siding 202 and the second vertical siding 204. In certain exemplary embodiments, the protrusion 126 of the first vertical siding 202 is offset from the protrusion 126 of the second vertical siding 204. Thus, when a corresponding chill block 110 is inserted into the receiving feature 118, the chill block 110 is retained in the receiving feature by the protrusions 126. In certain exemplary embodiments, the protrusions 126 extend around two edges of the chill block 110, in which the chill block 110 is substantially held between the protrusions 126 and the recessed surface 124. In other exemplary embodiments, the protrusions 126 extend into complementary recesses formed along the sides of the chill block 110. In both such exemplary embodiments, the chill block 110 is vertically removable from the receiving feature but horizontally locked within the receiving feature 118 by the protrusions 126 when the chill chamber 200 is upright.

FIGS. 2 and 3 provide one exemplary embodiment of the above configuration. Specifically, the receiving feature 118 illustrated in FIGS. 2 and 3 is of a "dovetail" shape, in which the distance between the protrusions 126 of the first and second vertical sidings 202, 204, which is positioned substantially at the distal ends 207, is smaller or narrower, than the distance between the back ends 206 of the first and second vertical sidings 202, 204. Thus, a chill block 110 having a corresponding shape (i.e., narrow front side 304 and broad back side 306) is retainable within the receiving feature 118.

In certain other exemplary embodiments, the receiving feature 118 is configured differently. For example, in another exemplary embodiment, the vertical sidings 202, 204 include a concave curved or semi-circle shape when seen from a top view, and the chill block 110 includes a corresponding convex shape, allowing it to vertically slide into and be horizontally retained by the receiving feature 118.

In certain exemplary embodiments, when liquid inside the chill block 110 is frozen, the shape of the chill block 110 expands. For example, the front side 304 and/or back side 306 of the chill block 110 may protrude outward slightly. In such exemplary embodiments, the corresponding receiving feature 118 is shaped to accommodate expansion of the chill block 110 while still effectively retaining the chill block 110 when it returns to the original shape as the liquid melts. Specifically, in certain exemplary embodiments, the receiving feature 118 includes an expansion space 302 formed within the recessed surface 124. The expansion space 302 is further recessed with respect to the recessed surface 124. The expansion space 302 accommodates the expanded shape of the chill block 110 while allowing the chill block 110 to remain properly retained when it returns to its smaller size.

Figure 4:
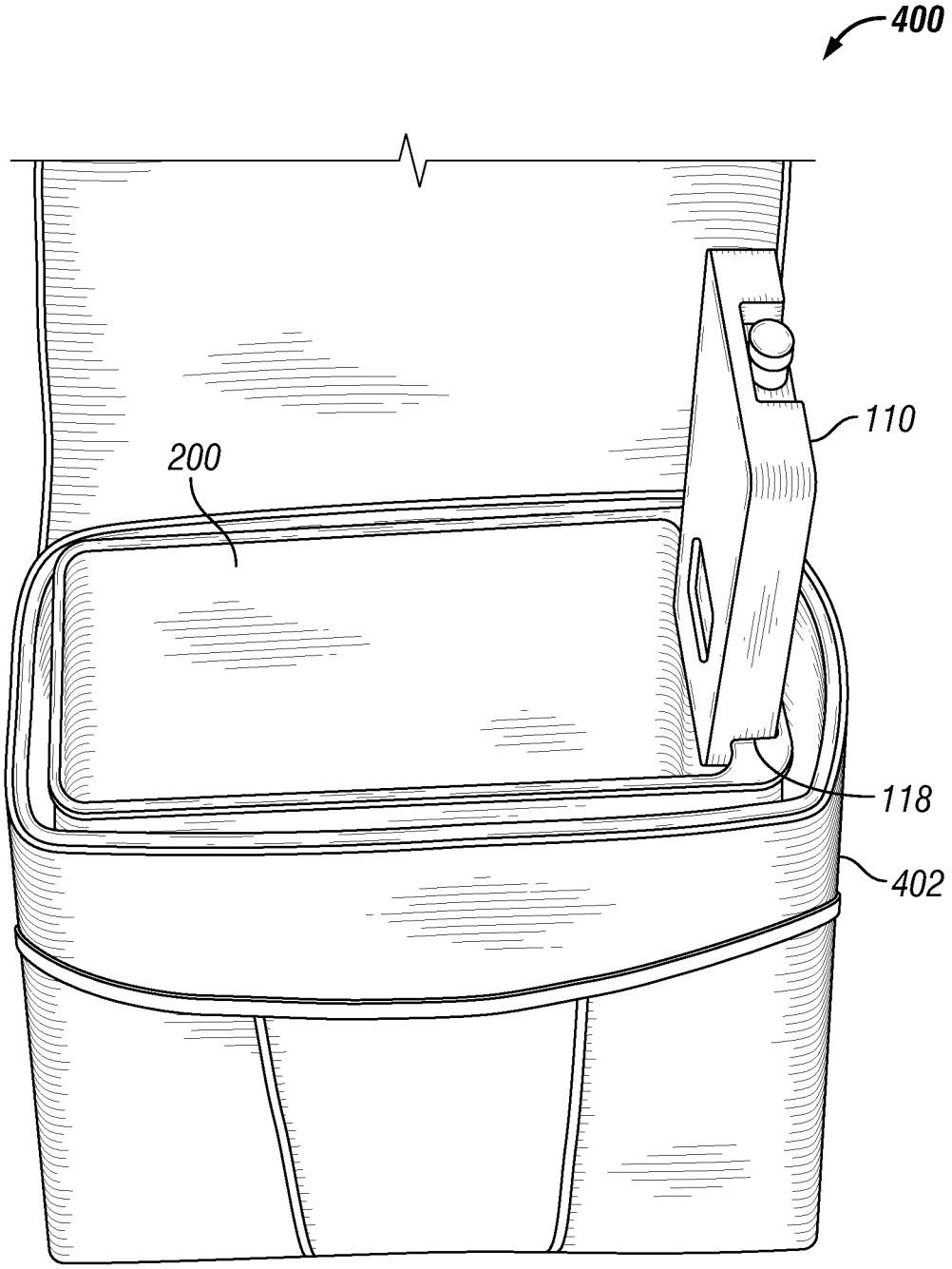
FIG. 4 shows a perspective view of a soft-sided cooler having an iceless chill chamber cooler, in accordance with one or more exemplary embodiments.

FIG. 4 illustrates an iceless chill chamber cooler 400 in which the iceless chill chamber 200 is inserted into a soft-bodied cooler body 402. In certain exemplary embodiments, the iceless chill chamber 200 is removable from, and not integrated with, the cooler body 402. In such an exemplary case, the iceless chill chamber 200 is insertable inside a cooler body 402 that is large enough to accommodate the iceless chill chamber 200. According to certain exemplary embodiments, the cooler body 402 is specially designed to be used with the iceless chill chamber 200 or, in alternative exemplary embodiments, the cooler body 402 is an existing conventional cooler. In certain other exemplary embodiments, the cooler body is a hard-sided cooler. In one or more exemplary embodiments, the dimensions of the iceless chill chamber 200 are such that the iceless chill chamber 200 fits snugly within the cooler body 402. The iceless chill chamber 200 illustrated in FIG. 4 includes one receiving feature 118 configured to receive one chill block 110. However, in other exemplary embodiments, the iceless chill chamber includes more than one receiving feature 118 and more than one chill block 110.

Figure 5B:
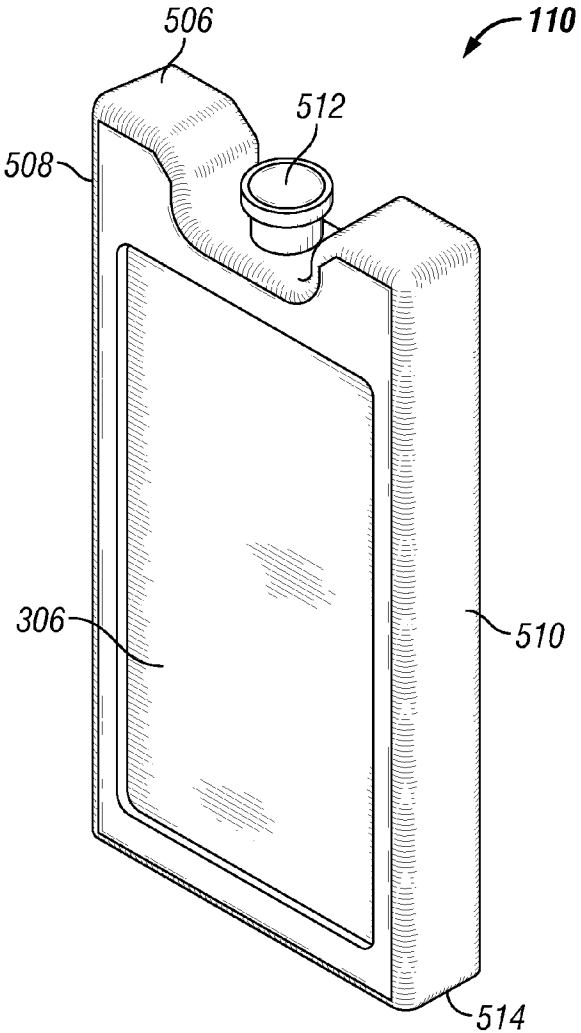
FIG. 5*b* shows a perspective rear view of the chill block of FIG. 5*a*, in accordance with one or more exemplary embodiments.
Figure 5A:
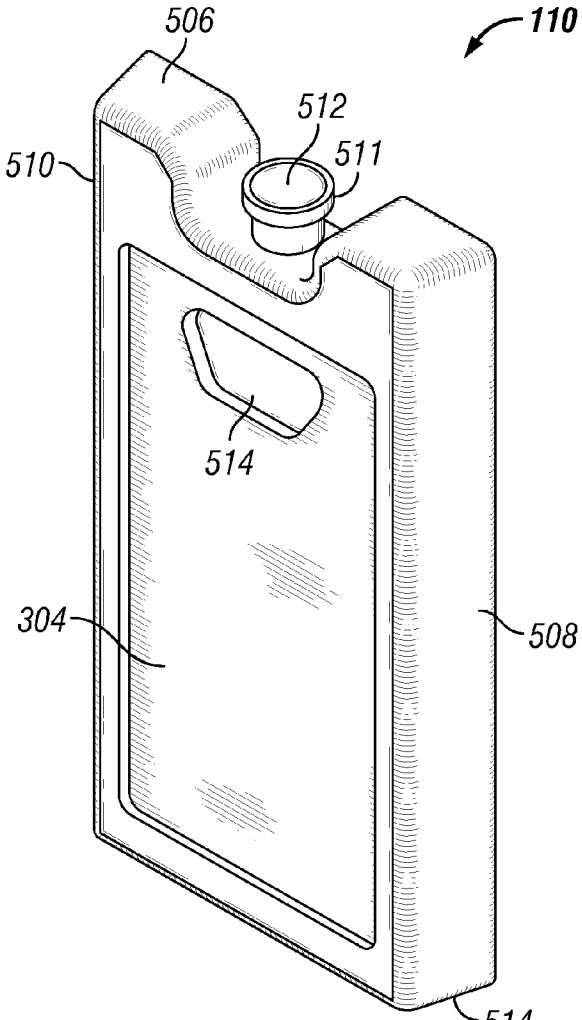
FIG. 5*a* shows a perspective front view of a chill block, in accordance with one or more exemplary embodiments.
Figure 5C:
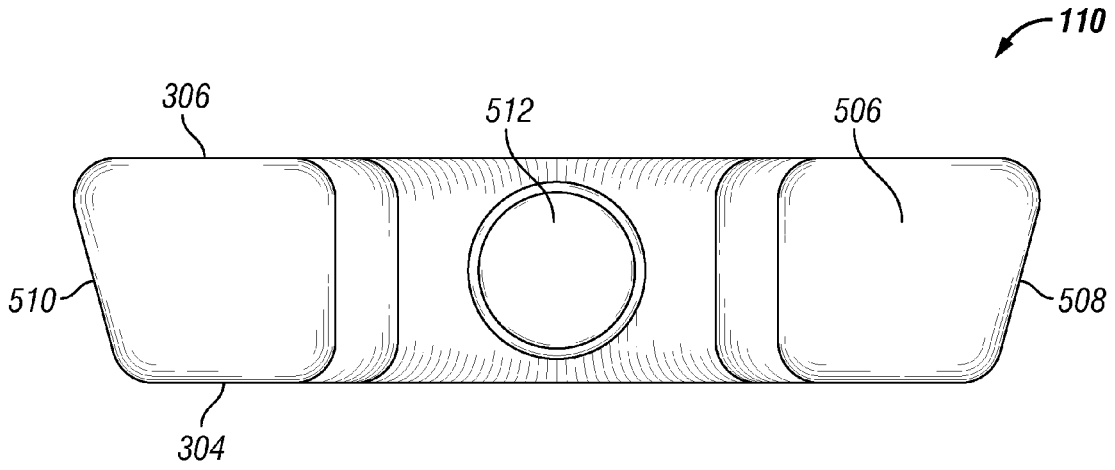
FIG. 5*c* shows a top view of the chill block of FIG. 5*a*, in accordance with one or more exemplary embodiments.

In one or more exemplary embodiments, the shape of receiving feature 118 complements the shape of the chill chamber block 110. The chill chamber block 110 typically includes one or more of a number of features. FIG. 5*a* illustrates a perspective front view of the chill block 110 in accordance with one or more exemplary embodiments of the present disclosure. FIG. 5*b* illustrates a perspective rear view of the chill block 110 in accordance with one or more exemplary embodiments of the present disclosure. FIG. 5*c* illustrates a top view of the chill block 110 in accordance with one or more exemplary embodiments of the present disclosure. Referring to FIGS. 5*a*, 5*b*, and 5*c*, the chill block 110 includes the front side 304, the back side 306 opposite the front side, a first lateral side 508, a second lateral side 510 opposite the first lateral side 508, a top side 506, and a bottom side 514 opposite the top side 506. In certain example embodiments, the chill block 110 is hollow and contains a cavity bounded within the sides 304, 306, 506, 508, 510, and 514.

In one or more exemplary embodiments, the material of and inside the chill blocks 110 are commonly known in the art. For example, the chill blocks 110 are made of ethylene and may be filled with water or a water-based gel that has some salt content according to some exemplary embodiments. The shape of the chill blocks 110, however, as well as certain features of the chill chamber blocks 110, vary, in certain exemplary embodiments, depending on one or more of a number of factors, including but not limited to the shape of the receiving feature 118 in the iceless chill chamber 120, the type of fastening mechanism used to secure the chill blocks 110 to the iceless chill chamber 120, the size of the cooler body 140, etc.

In the illustrated exemplary embodiment as shown in FIG. 5*c*, the chill block 110 has a trapezoidal shape when viewed from the top. This is otherwise known as a "dovetail" shape, which is complementary to that of the example receiving feature 118 illustrated in FIGS. 2 and 3. Specifically, in such an exemplary embodiment, the front side 304 of the chill block 110 is narrower in width than the back side 306. The chill block 110 is to be inserted into the receiving feature 118 with the back side 306 facing the recessed surface 124. Thus, when the chill block 110 is inserted into the complementarily shaped receiving feature 118, the chill block 110 is retained within the receiving feature 118. Specifically, the distance, or opening between the distal ends 207 of the first and second vertical sidings 202, 204 is smaller than the width of the back side 306 of the chill block 110. The chill block 110 cannot freely move past the distal ends 207, and is thus retained within the receiving feature 118.

In certain exemplary embodiments, the distance across the front side 304 of the chill block 110 from the first lateral side 508 to the second lateral side 510 is smaller than the maximum distance between the first lateral side 508 and the second lateral side 510. In certain exemplary embodiments, the lateral sides 508, 510 are straight. In certain other exemplary embodiments, the lateral sides 508, 510 are curved, angled, or otherwise formed such that when the chill block 110 is disposed in a complementarily-shaped receiving feature, the chill block 110 is horizontally retained.

In certain exemplary embodiments, the top side 506 of the chill block 110 includes an opening mouth 511 and a removable cap 512 coupled to the opening mouth 511. The opening mouth 511, when the cap 512 is removed, fluidly couples the cavity within the chill block 110 to outside of the chill block 110. Otherwise, when the cap 512 is coupled to the opening mouth 511, the cavity within the chill block 110 is isolated from the exterior of the chill block 110. The cap 512 is coupled to the opening mouth 511 by mating threads, snap on features, and the like, according to some exemplary embodiments. Thus, the chill block 110 is filled or emptied via the opening mouth 511. In certain exemplary embodiments, the chill block 110 further includes a gripping feature 514 on the front side 304 of the chill block 110. The gripping feature 514 is recessed into the front side 304, according to certain exemplary embodiments, and allows a user to grip the chill block 110 and vertically remove it from the receiving feature 118. Alternatively, in other exemplary embodiments, the gripping feature 514 protrudes outwardly from the front side 304.

Figure 6:
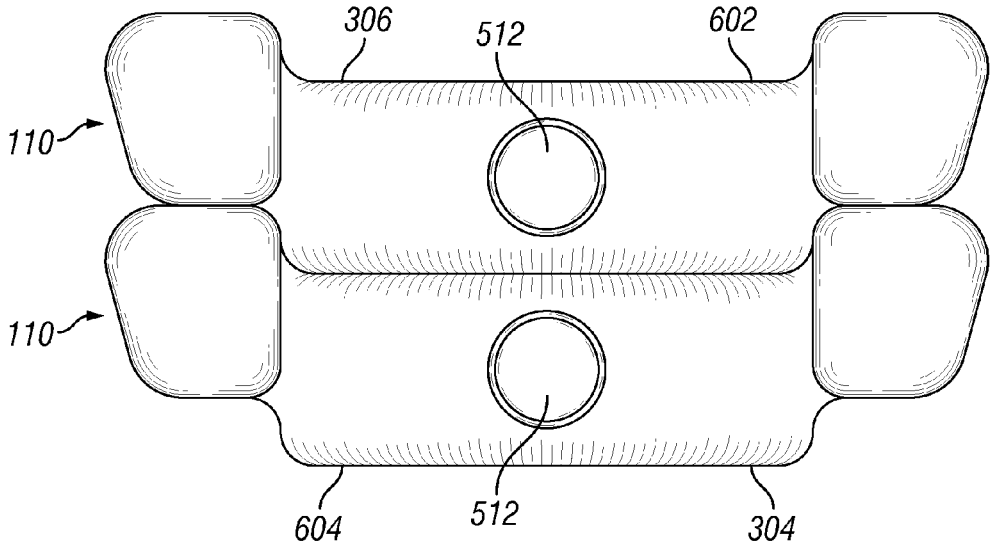
FIG. 6 shows a top view of a plurality of chill blocks in a stacked configuration, in accordance with one or more exemplary embodiments.

FIG. 6 illustrates two chill blocks 110 in a stacked configuration, in accordance with an exemplary embodiment of the disclosure. In an exemplary embodiment, the back side 306 of the chill block 110 includes a rear coupling feature 602 such a recessed portion as shown in FIG. 5. The front side 304 of the chill block includes a front coupling feature 604 such as a protruded portion, in which the protruded portion is at least partially disposed within the rear coupling feature 602, or recessed portion, on the back side 306 of another adjacently positioned chill block 110. Thus, the chill blocks 110 are aligned and stacking is facilitated, which reduces storage space. In certain exemplary embodiments, the rear coupling feature 602 and the front coupling feature 604 include a snap or other semi-permanent coupling mechanism in which once the two chill blocks 110 are joined via the coupling features 602, 604, the chill blocks 110 generally do not separate without a applying a separating force thereto, in which the separating force is greater than that of gravity. In certain exemplary embodiments, two or more chill blocks 110 are joined together in this way.

In one or more example embodiments, the iceless chill chamber cooler is integrated with a cooler. Alternatively, the iceless chill chamber cooler is removable and used with a cooler currently known in the art. The chill chamber blocks are coupled to one or more sides of the iceless chill chamber. The chill chamber blocks may also, or in the alternative, be coupled to a bottom and/or top side or lid of the iceless chill chamber.

Example embodiments of the iceless chill chamber cooler described herein allow for relatively more effective and less expensive cooling of items inside a cooler. The use of the chill chamber blocks reduces the amount of condensation/water that accumulates in the cooler over time, which reduces the chance of spoiling food and/or paper items stored in the cooler. Further, the use of the chill chamber blocks reduces the inconvenience of a user having to dig through ice and other cooling obstacles to find an item in the cooler. In addition, in a number of areas, ice and other cooling devices may not be readily available, which is an added benefit to using chill chamber blocks according to example embodiments.

Example embodiments also allow more items to be stored in the cooler, because the chill chamber blocks are coupled to surfaces of the iceless chill chamber rather than mixed in the cooler body with the items to be cooled. Further, because the chill chamber blocks are located on the sides of the iceless chill chamber, condensation that accumulates on the chill chamber blocks over time will not drip onto the items in the cooler, which occurs with cooling devices that are affixed to the underside of the lid of the cooler. In addition, because the chill chamber blocks are located on the sides of the iceless chill chamber, heat and thermal conduction from the cooler lid has less of a melting effect on the chill chamber blocks, which keeps the contents of the cooler at a lower temperature for a longer period of time.

In addition, a power source does not need to be electrically coupled to the cooler using example embodiments described herein. As a result, a power supply is not required to use example embodiments. Consequently, energy costs are reduced, and reliability and cooling performance is increased. Further, using example embodiments described herein, the overall weight of the cooler is reduced when cooling items inside the cooler. The cooler using example embodiments described herein allows the cooler and its contents to be mobile. Further, example embodiments described herein are reusable. Further, the iceless chill chamber cooler is durable and will not break when dropped frozen or thawed.

The size, mass, and/or shape of the chill chamber blocks allow the chill chamber blocks to stay frozen longer using example embodiments described herein. Further, because the chill chamber blocks are coupled to the iceless chill chamber, the chill chamber blocks will not dislodge and become mixed with the items being cooled in the cooler.

Accordingly, many modifications and other embodiments not set forth herein will come to mind to one skilled in the art to which iceless chill chamber coolers pertain having the benefit of the teachings presented in the foregoing descriptions and the associated drawings. Therefore, it is to be understood that iceless chill chamber coolers are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An iceless chill chamber cooler, comprising:

a chill chamber comprising a base and at least one wall extending from the perimeter of the base, wherein at least a portion of the at least one wall comprises a receiving feature configured to removably receive and retain a chill block, wherein the receiving feature comprises a first vertical siding and a second vertical siding opposite the first vertical siding, the first vertical siding and the second vertical siding each comprising an inward facing protrusion, wherein the distance between the first and second vertical sidings is larger towards the wall than the distance between the first and second vertical sidings further from the wall, wherein the first and second vertical sidings substantially form a trapezoidal shape with the wall, the wall being the largest side of the trapezoidal shape, and wherein when disposed in the receiving feature, the chill block is retained between the first vertical siding and the second vertical siding.

2. The iceless chill chamber cooler of claim 1, wherein the distance between the protrusion of the first vertical siding and the protrusion of the second vertical siding is smaller than the maximum distance between the first vertical siding and the second vertical siding.

3. The iceless chill chamber cooler of claim 1, wherein the chill chamber is integrated with a cooler body.

4. The iceless chill chamber cooler of claim 1, wherein the chill chamber is removable from a cooler body.

5. The iceless chill chamber cooler of claim 1, wherein the chill chamber is disposed within a cooler body comprising a hard exterior.

6. The iceless chill chamber cooler of claim 1, wherein the chill chamber is disposed within a cooler body comprising a soft exterior.

7. The iceless chill chamber cooler of claim 1, wherein the chill block is vertically removable from the receiving feature and horizontally locked within the receiving feature when the iceless chill chamber cooler is upright.

8. The iceless chill chamber cooler of claim 1, wherein the receiving feature comprises an expansion space, the expansion space accommodating an expansion in size of the chill block when the chill block is frozen.

9. The iceless chill chamber cooler of claim 1, further comprising:

a chill block configured to be received and retained by the receiving feature, wherein the chill block comprises a shape corresponding to the shape of the receiving feature, and wherein the chill block is vertically insertable into the receiving feature and horizontally locked within the receiving feature.

10. A chill block comprising:

an outer shell comprising a top side, a bottom side opposite the top side, a front side, a back side opposite the front side, a first lateral side, and a second lateral side opposite the first lateral side, the first and second lateral sides coupling the front side and the back side, wherein the top, bottom, front, back, first lateral, and second lateral sides form a cavity therebetween configured to hold a volume of freezable liquid;

wherein a first distance between the first lateral side and the second lateral side is smaller than a second distance between the first lateral side and the second lateral side, wherein the first distance is measured closer to the front side and the second distance is measured closer to the back side, wherein both measurements are made substantially parallel to the back side.

11. The chill block of claim 10, wherein the front side is narrower than the back side.

12. The chill block of claim 10, wherein the chill block comprises an interlocking mechanism, wherein the chill block is couplable to a second chill block via the interlocking mechanism.

13. The chill block of claim 10, wherein the first lateral side, the second lateral side, or both comprise a recessed portion.

14. The chill block of claim 10, wherein the chill block comprises a gripping feature disposed on the front side.

15. The chill block of claim 10, wherein the chill block is vertically removable from a receiving feature of an iceless chill chamber and horizontally locked within the receiving feature when the iceless chill chamber cooler is upright.

* * * * *